US007851731B2

(12) United States Patent
Ly

(10) Patent No.: US 7,851,731 B2
(45) **Date of Patent: *Dec. 14, 2010**

(54) APPARATUS AND METHOD FOR MICROWAVE COOKING OF A FOOD PRODUCT

(75) Inventor: Bunlim Ly, Chicago, IL (US)

(73) Assignee: Kraft Foods Global Brands LLC, Northfield, IL (US)

( * ) Notice: Subject to any disclaimer, the term of this patent is extended or adjusted under 35 U.S.C. 154(b) by 258 days.

This patent is subject to a terminal disclaimer.

(21) Appl. No.: 11/555,079

(22) Filed: Oct. 31, 2006

(65) Prior Publication Data

US 2008/0149626 A1 Jun. 26, 2008

(51) Int. Cl.
*H05B 6/80* (2006.01)
*B65D 81/34* (2006.01)

(52) U.S. Cl. ..... 219/730; 219/732; 219/725; 426/107

(58) Field of Classification Search ..... 219/725–735, 219/759, 762; 426/107, 109, 113, 118, 234, 426/241, 243; 99/DIG. 14
See application file for complete search history.

(56) References Cited

U.S. PATENT DOCUMENTS

| | | | | |
|---|---|---|---|---|
| 2,686,129 | A * | 8/1954 | Seiferth | 426/113 |
| 3,943,320 | A * | 3/1976 | Bowen | 219/728 |
| 4,015,085 | A | 3/1977 | Woods | |
| 4,190,757 | A | 2/1980 | Turpin et al. | |
| 4,705,929 | A | 11/1987 | Atkinson | |
| 4,745,249 | A | 5/1988 | Daniels | |
| 4,794,005 | A | 12/1988 | Swiontek | |
| 4,801,774 | A | 1/1989 | Hart | |
| 4,820,893 | A * | 4/1989 | Mode | 219/727 |
| 4,821,884 | A | 4/1989 | Griffin et al. | |
| 4,870,233 | A | 9/1989 | McDonald et al. | |

(Continued)

FOREIGN PATENT DOCUMENTS

| | | |
|---|---|---|
| EP | 0205304 | 12/1986 |

(Continued)

OTHER PUBLICATIONS

Refrigerated / Frozen Sandwich Packaging Literature Search Results dated Jun. 6, 2006.

(Continued)

*Primary Examiner*—Joseph M Pelham
(74) *Attorney, Agent, or Firm*—Fitch, Even, Tabin & Flannery

(57) ABSTRACT

A cooking apparatus includes a susceptor surface configured to contact a plurality of locations around greater than 180 degrees of the circumference of the food product. Such contact provides for greater surface area contact between the food product and the susceptor for more uniform cooking and crispness. Further, the weight of the food product is used in conjunction with the configuration of the cooking apparatus to increase the surface area contact between the food product and the susceptor. A line of weakness is disposed along the base of the cooking apparatus to allow the side walls of the cooking apparatus to pivot about the line of weakness to open and close the apparatus to allow for insertion and/or removal of the food product. The construction of the cooking apparatus facilitates cool handling of the cooking apparatus after microwave cooking is complete.

22 Claims, 12 Drawing Sheets

U.S. PATENT DOCUMENTS

| | | | | | |
|---|---|---|---|---|---|
| 4,871,111 | A | | 10/1989 | Mode | |
| 4,916,280 | A | | 4/1990 | Havette | |
| 5,045,330 | A | | 9/1991 | Pawlowski | |
| 5,095,186 | A | | 3/1992 | Scott Russell et al. | |
| 5,140,119 | A | | 8/1992 | Brown et al. | |
| 5,153,402 | A | * | 10/1992 | Quick et al. | 219/730 |
| 5,175,404 | A | * | 12/1992 | Andreas et al. | 219/730 |
| 5,247,149 | A | * | 9/1993 | Peleg | 219/729 |
| 5,252,793 | A | | 10/1993 | Woods | |
| 5,270,066 | A | * | 12/1993 | Pawlowski | 426/107 |
| 5,334,820 | A | * | 8/1994 | Risch et al. | 219/730 |
| 5,416,304 | A | | 5/1995 | De La Cruz et al. | |
| 5,416,305 | A | | 5/1995 | Tambellini | |
| 5,543,606 | A | | 8/1996 | Gics | |
| 5,552,169 | A | | 9/1996 | Kannankeril et al. | |
| 5,588,587 | A | | 12/1996 | Stier et al. | |
| 5,704,483 | A | | 1/1998 | Groh | |
| 5,718,356 | A | * | 2/1998 | Nottingham et al. | 219/730 |
| 6,054,698 | A | * | 4/2000 | Mast | 219/730 |
| 6,063,415 | A | * | 5/2000 | Walters | 426/107 |
| 6,150,646 | A | | 11/2000 | Lai et al. | |
| 6,623,777 | B2 | | 9/2003 | Kawase et al. | |
| 6,847,021 | B2 | * | 1/2005 | Lefeuvre et al. | 219/730 |
| 2003/0080119 | A1 | * | 5/2003 | Chisholm et al. | 219/730 |
| 2003/0160047 | A1 | * | 8/2003 | Lefeuvre et al. | 219/730 |
| 2004/0023000 | A1 | | 2/2004 | Young et al. | |
| 2005/0133500 | A1 | | 6/2005 | Brooks et al. | |
| 2006/0113300 | A1 | * | 6/2006 | Wnek et al. | 219/730 |
| 2007/0228036 | A1 | * | 10/2007 | Noyelle et al. | 219/730 |
| 2007/0246460 | A1 | * | 10/2007 | Ford et al. | 219/730 |

FOREIGN PATENT DOCUMENTS

| | | |
|---|---|---|
| EP | 0320294 | 6/1989 |
| EP | 0824481 | 2/1998 |
| EP | 1181868 | 2/2002 |
| EP | 1291298 | 3/2003 |
| JP | 11243845 | 9/1999 |
| WO | 99/44428 | 9/1999 |
| WO | 03/003839 | 1/2003 |

OTHER PUBLICATIONS

Non-published U.S. Appl. No. 11/555,104, filed Oct. 31, 2006.
Non-published U.S. Appl. No. 11/537,929, filed Oct. 2, 2006.
Non-published U.S. Appl. No. 11/537,923, filed Oct. 2, 2006.

* cited by examiner

APPARATUS AND METHOD FOR MICROWAVE COOKING OF A FOOD PRODUCT

FIELD

This disclosure relates to an application for microwave cooking of a food product, and in particular to an apparatus for microwave cooking of a food product on a food container having a susceptor thereon.

BACKGROUND

Heretofore, considerable effort has been expended to provide food products such as frozen or refrigerated pizzas and sandwiches for preparation by a consumer, utilizing conventional gas or electric heated ovens. More recently, with the increasing popularity of microwave ovens, attention has turned to providing consumers with kits and components for preparing dough-containing products such as frozen or refrigerated pizzas and sandwiches.

As has been detailed in U.S. Pat. No. 5,416,304, microwave ovens exhibit their own unique challenges when preparing frozen food products. For example, microwave ovens exhibit substantial temperature gradients or non-uniform heating. In addition, frozen dough-containing products have been found to exhibit a nonuniform temperature response to microwave radiation throughout their volume, during a typical heating cycle. As a result, portions of the food item melt or thaw before other portions and this results in localized accelerated heating due to the preferential absorption of microwave energy by liquids being irradiated. In addition, the microwave heating of the frozen food product can typically produce moisture that can gather at the surface of the food product, thus resulting in a soggy food product.

Various specialized packages have been developed for microwave heating of a food product. However, the existing packages have several drawbacks. Many of the existing packages require multiple components that must be arranged by the consumer in a specific configuration. Such packaging requires extra packaging materials and requires the consumer to follow several steps in assembling the food product and package for microwave heating.

Further, many of the existing packages do not provide for effective cool handling of the packaged food product upon removal from the microwave. The increased temperature of the packaged food product can pose challenges for a consumer when handling the packaged food item and when removing the packaged food item from the microwave.

For certain types of food products, such as those products having a circular cross-section, many packages do not allow for increased surface area contact between the circular food product and the susceptor. Many cooking packages have a planar food cooking platform, such that only a small portion of the circular food product would contact the susceptor when placed on the platform.

As a result of these and other conditions, further improvements in the preparation and packaging of dough-containing food products are being sought.

SUMMARY

Figure 1:
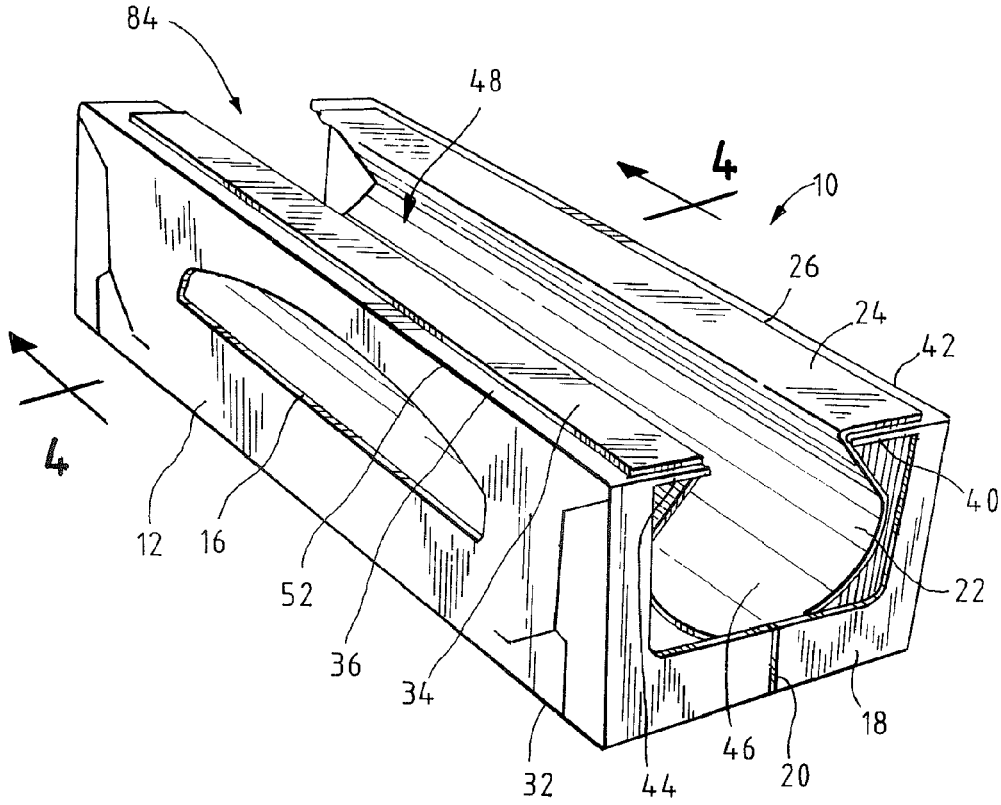
FIG. 1 is a perspective view of a first embodiment of a tray for microwave cooking of a food product.
Figure 2:
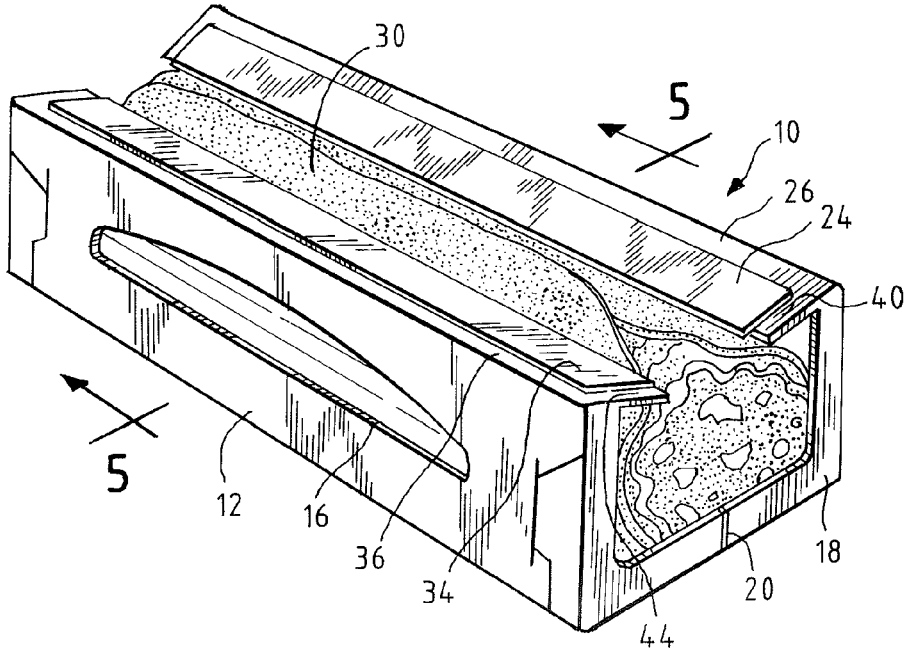
FIG. 2 is a perspective view of the tray of FIG. 1 shown in combination with a food product.

Various embodiments of a cooking apparatus for microwave cooking of a food product are disclosed. The cooking apparatus includes a susceptor surface configured to contact a plurality of locations around greater than 180 degrees of the perimeter of the food product. Such a configuration provides for greater surface area contact between the food product and the susceptor for more uniform cooking and crispness, such as when the food product is generally circular in cross-section. Further, the weight of the food product is used in conjunction with the configuration of the cooking apparatus to increase the surface area contact between the food product and the susceptor. A line of weakness is disposed along the base of the cooking apparatus to allow the side walls of the cooking apparatus to pivot about the line of weakness to open and close the apparatus to allow for insertion and/or removal of the food product. The construction of the cooking apparatus provides increased rigidity and support for the food product, while also facilitating cool handling of the cooking apparatus after microwave cooking is complete.

In one aspect, the cooking apparatus includes a pair of side walls having a susceptor suspended therebetween. When a food product is placed in the apparatus, the weight of the food product causes the suspended susceptor to generally conform to the shape of the food product. The susceptor has a span sufficient to contact a plurality of locations around greater than 180 degrees of the food product when a food product is in contact therewith. Further, a bottom wall extending between the side walls contains a line of weakness about which the side walls may pivot. Each side wall has an end wall extending therebetween to provide additional rigidity to the apparatus, with each end wall having a perforated score line aligned with the line of weakness. The perforated score lines may be torn to split each end wall in half to allow the apparatus to be opened by pivoting along the line of weakness. The side walls, end walls, and bottom wall allow a consumer to pick up the apparatus without contacting the susceptor to facilitate cool handling of the apparatus.

In another aspect, a cooking apparatus includes a pair of side walls and a pair of inclined portions having a susceptor surface disposed thereon. A base extends between the side walls and includes a line of weakness about which the side walls may pivot. When a food product is placed in the apparatus, the weight of the food product causes the side walls to pivot about the line of weakness and close in around the food product to cover an upper portion of the food product. Further, the inclined floor portions cover a lower portion of the food product. The susceptor surface disposed on the inner side walls and the inclined floor portions are thus able to contact a plurality of locations around greater than 180 degrees of the food product. The side walls can then be pivoted outwardly about the line of weakness to open the cooking apparatus and allow for access to the food product therein. Further, the susceptor surface is enclosed within the inner walls of the cooking apparatus, such that a consumer will generally avoid contacting the susceptor surface when retrieving the apparatus and cooked food product from the microwave.

DETAILED DESCRIPTION

Various embodiments of a cooking apparatus in accordance with the above-discussed aspects are illustrated in FIGS. 1-25 herein. The cooking apparatus includes a susceptor surface configured and arranged to contact a plurality of locations around greater than 180 degrees of the circumference of the food product. Greater surface area contact is achieved between the food product and the susceptor with such a configuration. In addition, greater surface area contact is accomplished by using the weight of the food product in conjunction with the configuration of the cooking apparatus to increase contact between the susceptor and the food product. The base of the cooking apparatus contains a line of weakness, such as a seam or score line. This line of weakness allows the side walls of the apparatus to pivot to opened and closed positions to allow for access to the interior of the cooking apparatus. The construction of the cooking apparatus also provides for cool handling of the cooking apparatus after microwave cooking is complete.

In microwave cooking, polar molecules such as water contained in the food product absorb microwave energy and release heat. Microwave energy typically penetrates further into the food than does heat generated in a conventional oven, such as radiant heat, with the result that water molecules dispersed throughout the food product are selectively heated more rapidly. Ideally, food products such as those in dough-based portions of wraps, strombolis, calzones, sandwiches, pockets, and other such food products must properly dissipate the heated moisture in order to avoid the dough-based portion becoming soggy.

The food product being prepared is preferably supported at an elevated position above the oven surface to allow a desirable portion of the moisture exiting the food product, such as if vents holes or slits are present in the food support surface or adjacent sidewalls, to become trapped in a determined volume so as to contribute controlled amounts of heat and moisture to the dough-based portion of the food product and to achieve a desirable brownness or crispness without becoming dried out, chewy, or hard. The food product is supported at an elevated position above the oven surface to allow cooking energy, such as microwaves, to be redirected to underneath the food product, to reach the bottom portion of the food product and achieve sufficient penetration of the food product.

Other problems associated with the use of microwave energy for the preparation of food products such as frozen or refrigerated sandwich wraps, pizzas, pockets and the like are also addressed. In general, certain instances of non-uniform heating can be associated with the preparation of food using microwave energy, such as electromagnetic radiation at a frequency of about 0.3 to 300 GHz. It can be important in order to achieve a cooked food product of pleasing appearance and texture that the dough-based portion of the food product be uniformly heated throughout the cooking. As is now generally accepted, power distribution in a microwave oven cavity can be non-uniform, giving rise to "hot spots" and "cold spots" about the environment of the food product being prepared.

Another problem in many practical applications arises from the fact that a food product, such as a frozen sandwich wraps, typically does not exhibit desirably uniform temperature response to microwave radiation throughout its volume during a typical heating cycle. For example, a frozen sandwich wrap when initially subjected to microwave radiation, undergoes local melting or thawing in certain portions of the sandwich wrap, with remaining portions of the sandwich wrap remaining frozen. This problem is accelerated in that thawed portions of a dough-based food product, such as a sandwich wrap, pocket, or the like, will preferentially absorb greater amounts of microwave energy than the surrounding frozen portions. A further understanding of difficulties encountered in preparing dough-containing food products such as frozen pizza may be found in U.S. Pat. No. 5,416,304, the disclosure of which is herein incorporated by reference as fully set forth herein. It is important therefore that initial thawing of the food product be made as uniform as possible throughout the food product and that the energy absorption throughout the remainder of the cooking cycle remain uniform. A number of different features of the cooking apparatus disclosed herein provide improved control of microwave cooking of dough-containing food products, throughout the cooking cycle.

In the first embodiment illustrated in FIGS. 1-7, a cooking apparatus 10 includes a pair of opposed upstanding side walls 12 connected by a bottom wall 14. The bottom wall 14 extends between a bottom edge 32 of each side wall 12. A pair of opposed end walls 18 extend between and transverse to the opposed upstanding side walls 12. The end walls may be fully or partially enclosed. As shown in FIG. 1, the end walls 18 are partially enclosed with end wall portions adjacent each side wall and the bottom wall and an open top and center portion 46. The open portion 46 of the end wall 18 assists in allowing steam vapor to exit the food product 30 during the cooking cycle. The side walls 12 and end walls 18 assist in controlling the food product within the cooking apparatus 10 by restricting shifting or movement of the food product 30 while it is contained in the cooking apparatus 10. The pair of opposed upstanding side walls 12 are fixed a predetermined distance apart by at least one of the bottom wall 14 and the end walls 18. As illustrated, the side walls 12 are generally rectangular in shape and sized to accommodate a food product 30. The bottom wall 14, side walls 12, and end walls 18 allow a consumer to remove the food product 30 from a microwave without touching the susceptor, thus facilitating cool handling of the cooking apparatus 10. At least one of the side walls 12 may have at least one vent aperture 16 formed therethrough to allow for the venting of steam during the cooking cycle. Excess amounts of steam or water vapor can exit the inner cavity 48 of the cooking apparatus 10 through the vent 16 in each side wall 12. In addition, the vents facilitate cooling of the food product 30 and the cooking apparatus 10 after the cooking cycle. The illustrated embodiment shows one longitudinal vent on each side wall 12. However, other numbers, shapes, and configurations of vents may be used.

A first inwardly directed side wall extension 26 extends from an upper edge 42 of one of the side walls and a second inwardly directed side wall extension 36 extends from an upper edge 52 of the opposing one of the side walls. Each extension 26, 36 generally extends along the entire length of the side wall 12 and is attached to the end wall 18. Further, each extension may have an extension tab 40, 44 extending therefrom adjacent each end wall 18, with each extension tab 40, 44 being unattached to the end wall 18 (also shown in the blank of FIG. 7). A first side 24 of the susceptor 22 is attached to the pair of extension tabs 40 extending from the first extension 26 and a second side 34 of the susceptor 22 is attached to the pair of extension tabs 44 extending from the second extension 36. Each extension 26, 36 and corresponding extension tabs 40, 44 extend toward the center of the food apparatus 10 and partially cover the bottom wall 14 with a gap 84 therebetween. The gap 84 may be generally sized to accommodate the food product 30, or may be smaller than the food product 30, with the extension tabs 40, 44 being foldable along a fold line to accommodate insertion of the food product 30. The susceptor hangs from each of the side wall extensions 26, 36 into the inner cavity 48 of the cooking apparatus 10. The susceptor 22 is preferably rectangular in shape when flat, and forms a generally partially arcuate shape when suspended.

Figure 3:
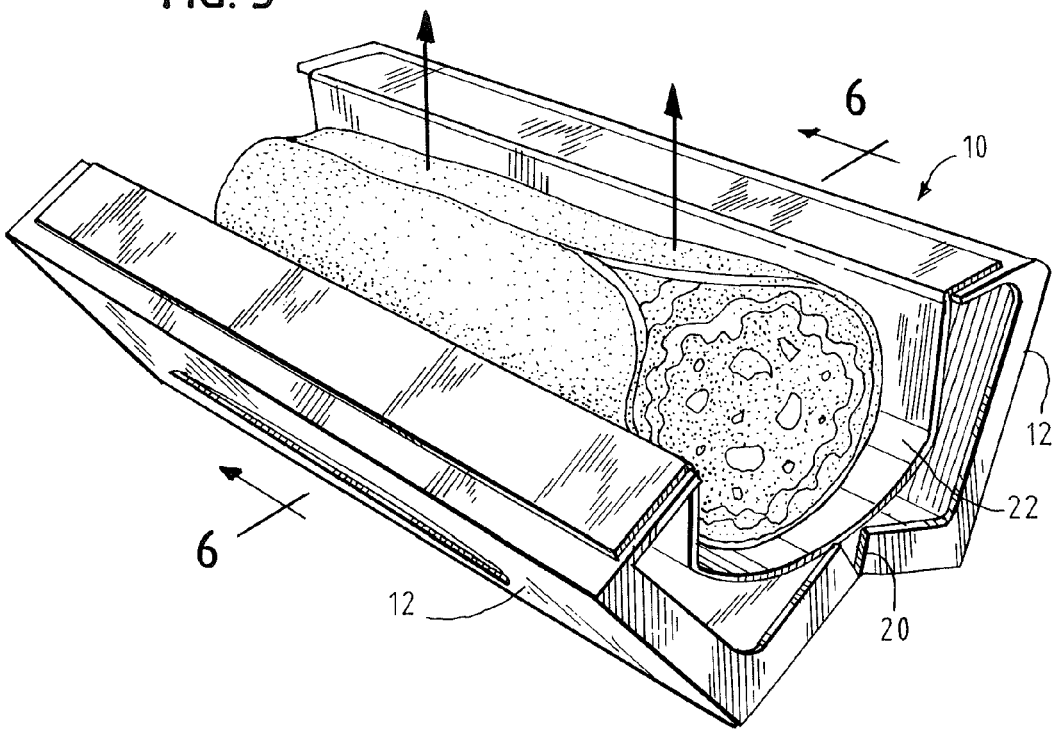
FIG. 3 is a perspective view of the tray of FIG. 2 shown in an open configuration.
Figure 4:
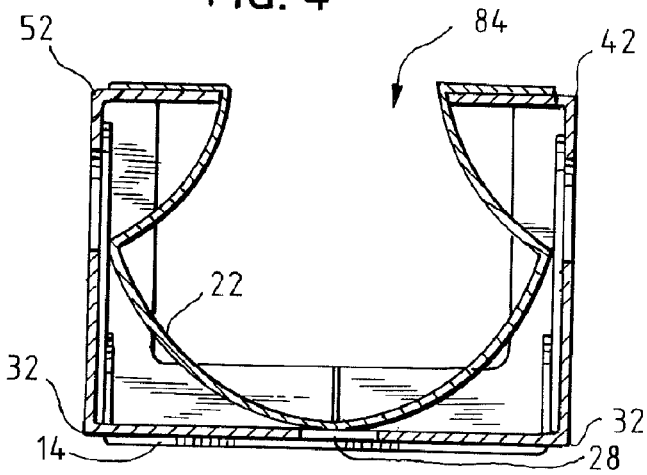
FIG. 4 is a cross-sectional elevation view of the tray of FIG. 1 taken along line 4-4 thereof.
Figure 5:
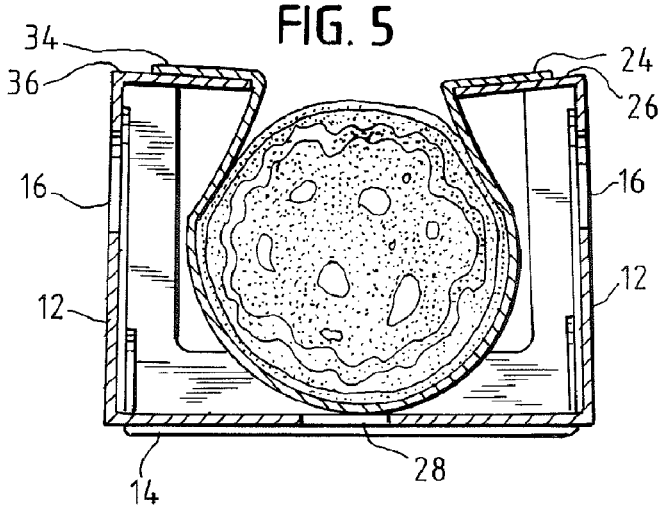
FIG. 5 is a cross-sectional elevation view of the tray and food product combination of FIG. 2 taken along line 5-5.
Figure 6:
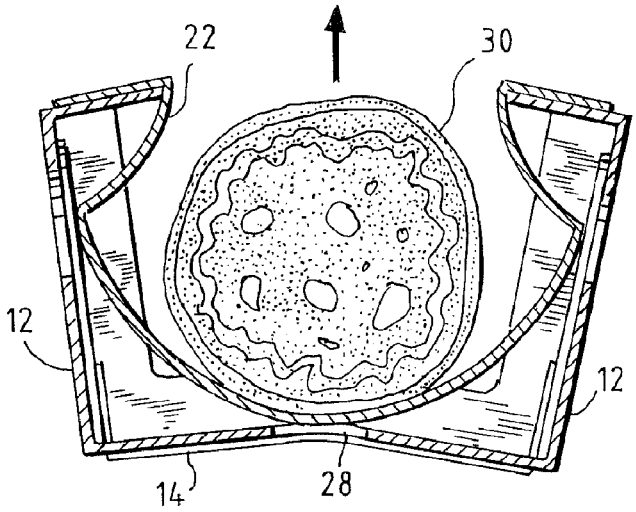
FIG. 6 is a cross-sectional elevation view of the tray and food product combination of FIG. 3 taken along line 6-6.

The susceptor 22 provides for conductive heating of the food product 30 in contact therewith. When the food product 30 is inserted into the cooking apparatus 10 and placed on the suspended susceptor 22, the weight of the food product 30 causes portions of the susceptor 22 to take the shape of the food product 30. The weight of the food product 30 is used to facilitate increased surface area contact between the food product 30 and the susceptor 22. Preferably, the susceptor 22 contacts a plurality of locations around greater than 180 degrees of the circumference of the food product 30, such as shown in FIG. 5. The susceptor 22 is generally sized to accommodate for such contact. The cooking apparatus 10 is preferably used for food products having a generally circular cross-section, such as food products that are round, elliptical, curvilinear, polygonal, comprised of curved and straight edges, and so forth. In the embodiments shown, such as in FIG. 5, the food product 30 is shown having a substantially circular cross-section, although other food product shapes may be contemplated The bottom wall 14 of the cooking apparatus 10 may contain a seam 28 or other line of weakness. The line of weakness may comprise, for example, a perforation, aperture, separation, or scored line, or a combination thereof. The seam 28 allows the side walls 12 to pivot about the seam 28 to thereby allow the cooking apparatus 10 to be opened to allow access to the food product 30, as illustrated in FIGS. 3 and 6. To further facilitate the opening of the cooking apparatus 10, each end wall 18 may have a perforated score line 20 generally aligned with the seam 28 of the bottom wall 14. As illustrated in FIG. 3, the perforated score line 20 may be torn to thereby separate the end wall 18 into two portions. The torn score line 20 allows the end wall 18 to separate to thereby allow the side walls 12 to further pivot about the bottom wall seam 28. After periods of cooking and cooling, the side walls 12 of the cooking apparatus 10 may then be pulled apart to open the cooking apparatus 10 and allow for access to and removal of the food product 30 from the cooking apparatus 10.

Figure 7:
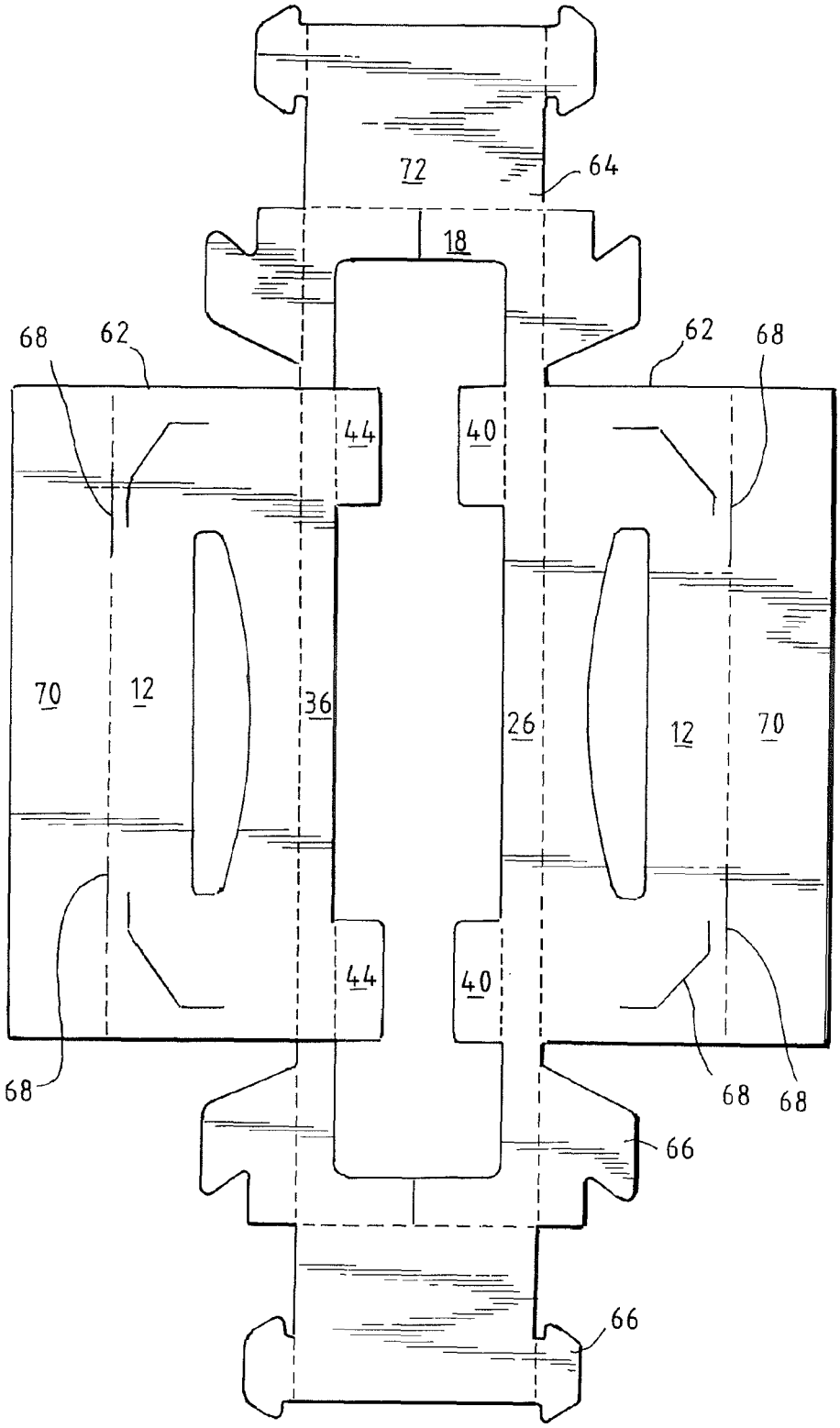
FIG. 7 is a plan view of a unitary blank for forming the tray of FIG. 1.

Preferably, though not necessarily, the side walls 12, the bottom wall 14, and the end walls 18 of the cooking apparatus 10 are formed from a single unitary blank 50 of material, such as paperboard. Forming the cooking apparatus 10 from a single unitary blank 50 can eliminate the need for separately attaching any of the bottom wall, end walls, or side wall to each other, such as by using adhesive. The unitary blank 50 includes multiple panels connected via fold lines, such as weakened or scored lines, as illustrated in FIG. 7, suitable for facilitating folding of the blank 50 into the cooking apparatus 10. The panels include a pair of side panels 62 and a pair of end panels 64.

The pair of side panels 62 form the side walls 12, the extensions 26, 36 and tabs 40, 44, and a portion of the bottom wall 14. The side panels 62 include bottom longitudinal panel portions 70 that are folded under to form a portion of the bottom wall 14. The bottom panels portions 70 do not fully enclose the bottom of the cooking apparatus 10, thus forming the separation or seam 28 about which the side walls can pivot. The pair of end panels 64 form the end walls 18 and a portion of the bottom wall 14. The end panels 64 include bottom end panel portions 72 that are folded under and overlap with the longitudinal panel portions 70 to form a portion of the bottom wall 14. The bottom end panel portions 72 may optionally include a score line or line of weakness aligned with the seam 28 formed by the space between the longitudinal panels 70 to facilitate the pivoting of the side walls. A plurality of tabs 66 extend from the end panels 64 with a plurality of corresponding slits 68 in the side panels 62 for insertion therein to maintain the blank 50 in a folded, assembled configuration. The susceptor 22 may be attached to the blank 50 upon completion of its folding or at intermediate steps thereof. The susceptor 22 may be attached to the blank 50 using, for example, an adhesive.

Figure 8:
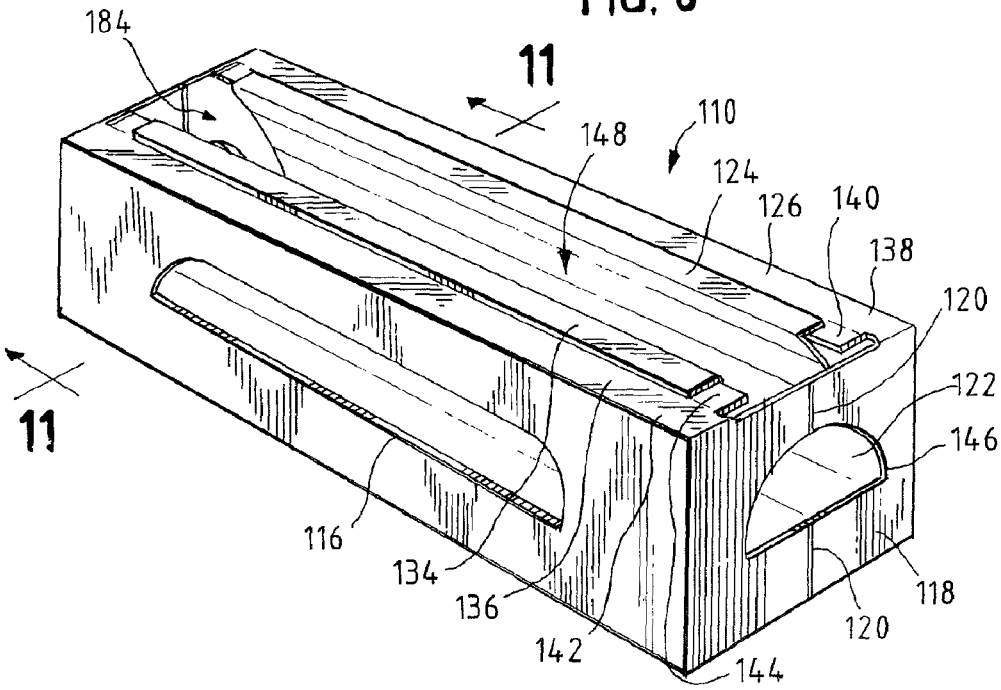
FIG. 8 is a perspective of a second embodiment of a tray for microwave cooking of a food product.
Figure 9:
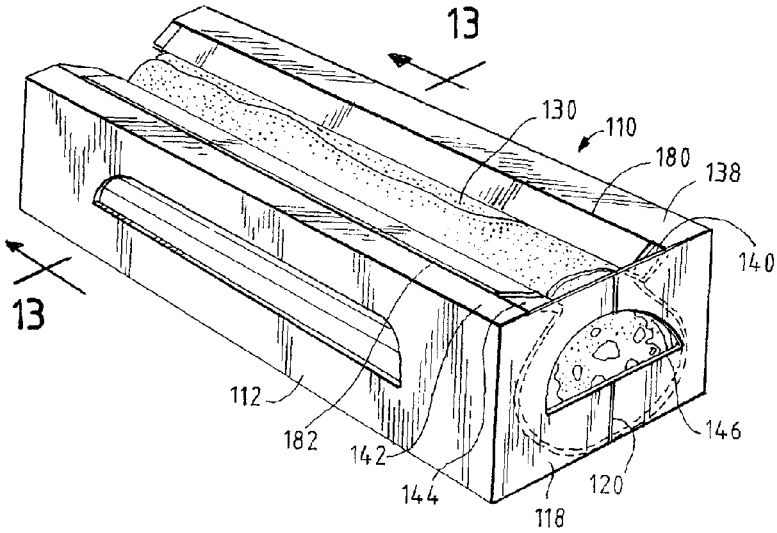
FIG. 9 is a perspective view of the tray of FIG. 1 shown in combination with a food product.

A second embodiment of a cooking apparatus 110 is illustrated in FIGS. 8-15. The apparatus 110 is similar in construction to the first embodiment illustrated in FIGS. 1-7, but with some modifications and additional features. As with the first embodiment, the cooking apparatus 110 includes a pair of opposed upstanding side walls 112 with a bottom wall 114 extending therebetween. A pair of opposed end walls 118 extend between and transverse to the opposed upstanding side walls 112. As shown in FIG. 8, the end walls 118 are enclosed around the perimeter with a center aperture 146 disposed therein. The aperture 146 facilitates venting of a food product 130 contained in the cooking apparatus 110 during cooking. The pair of opposed upstanding side walls 112 are fixed a predetermined distance apart by at least one of the bottom wall 114 and the end walls 118. The bottom wall 114, side walls 112, and end walls 118 allow a consumer to remove the food product 130 from a microwave without touching the susceptor 122, thus facilitating cool handling of the cooking apparatus 110. At least one of the side walls 112 may have at least one vent aperture 116 formed therethrough to allow for the venting of steam during the cooking cycle. The vents 116 also facilitate cooling of the food product 130 and the cooking apparatus 110 after the cooking cycle.

A susceptor 122 is suspended between the two side walls 112. A first side 124 of the susceptor 122 is attached to a first inwardly directed side wall extension 126 and an opposing side 134 of the susceptor 122 is attached to a second inwardly directed side wall extension 136. Each extension 126, 136 extends from the corresponding side wall 112 to partially cover the bottom wall with a gap 184 therebetween. In this embodiment, the gap 184 between the ends of the first extension 126 and second extension 136 is smaller than the diameter of the food product 130. The susceptor hangs from each of the side wall extensions 126, 136 into the inner cavity 148 of the cooking apparatus 110. The susceptor 122 is preferably rectangular in shape when flat, and forms a generally partially arcuate shape when suspended.

In this embodiment, each side wall extension 126, 136 is partially attached at each end to the end walls 118 to thereby provide for an attached portion 138 and an unattached portion 140 of the first extension 126 and an attached portion 142 and an unattached portion 144 of the second extension 136. The susceptor 122 is generally attached to the unattached portions 140, 144 of each extension 126, 136. A first transverse fold line 180 separates the attached 138 and unattached portions 140 of the first extension 126 and a second transverse fold line 182 separates the attached 142 and unattached 144 portions of the second extension 136.

Figure 12:
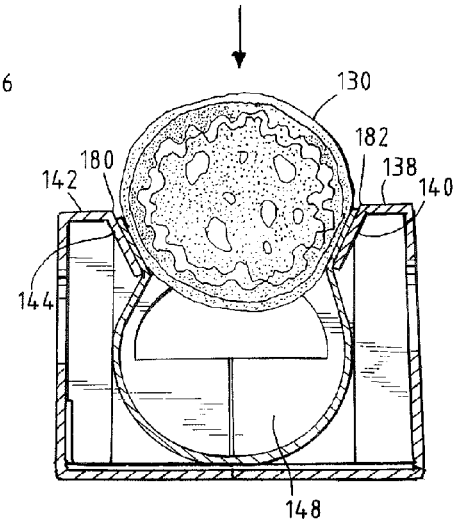
FIG. 12 is a cross-sectional elevation view of the tray of FIG. 8 with the food product partially inserted therein.
Figure 13:
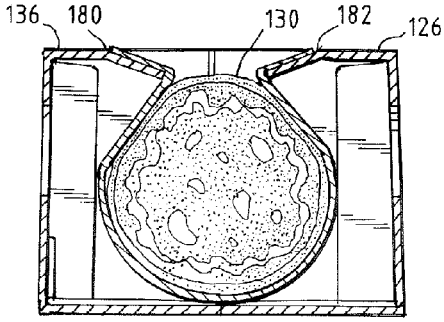
FIG. 13 is a cross-sectional elevation view of the tray of FIG. 9 taken along line 13-13.

FIG. 12 illustrates the food product 130 being inserted into the cooking apparatus 110. As mentioned the gap 184 between the first extension 126 and the second extension 136 is smaller than the diameter of the food product 130. Therefore, to accommodate the food product 130 during insertion into the cooking apparatus 110, the unattached portion 140 of the first extension 126 folds down into the inner cavity 148 along fold line 180 and the unattached portion 144 of the second extension 136 folds down into the inner cavity 148 along fold line 182. As the food product 130 is pushed against the unattached portions 140, 144 of the extensions 126, 136, the unattached portions 140, 144 fold down to allow the gap 184 to increase in size to accommodate the food product 130. FIG. 13 shows the food product 130 fully inserted into the cooking apparatus 110. When the food product 130 is fully inserted into the cooking apparatus 110 the unattached portions 140, 144 of the extensions 126, 136 return to their original position or a partially folded position.

The susceptor 122 provides for conductive heating of the food product 130 in contact therewith. When the food product 130 is inserted into the cooking apparatus 110, as described above, and placed on the suspended susceptor 122, the weight of the food product 130 causes the susceptor 122 to form around the food product 130. Thus, the weight of the food product 130 is used to facilitate increased surface area contact between the food product 130 and the susceptor 122. Preferably, the susceptor 122 contacts a plurality of locations around greater than 180 degrees of the circumference of the food product 130, such as shown in FIG. 13. The cooking apparatus 110 is preferably used for food products having a generally circular cross-section, such as food products that are round, elliptical, curvilinear, polygonal, comprised of curved and straight edges, and so forth, although other shapes may be contemplated.

Figure 10:
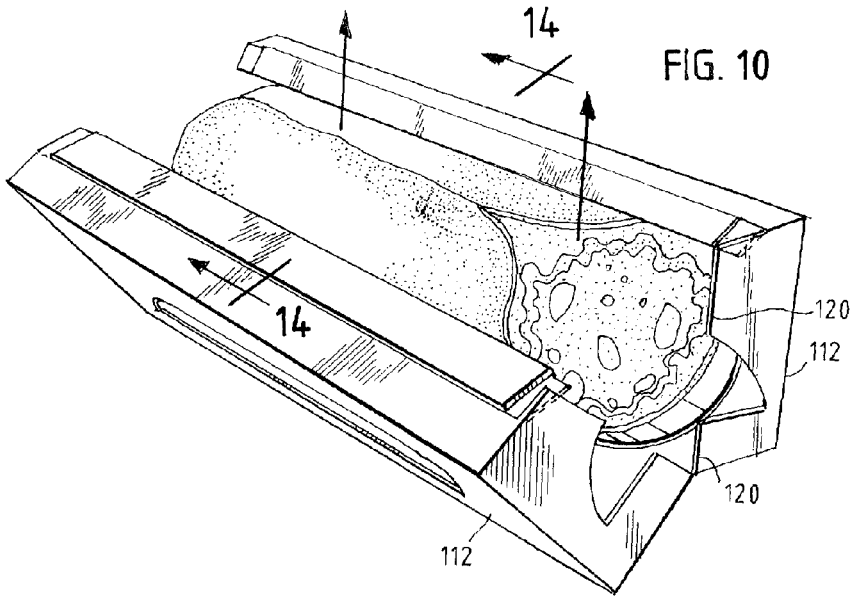
FIG. 10 is a perspective view of the tray of FIG. 9 shown in an open configuration.
Figure 11:
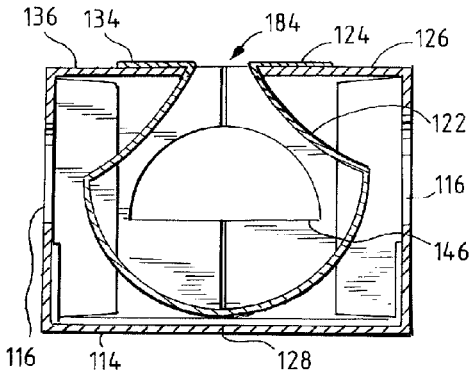
FIG. 11 is a cross-sectional elevation view of the tray of FIG. 8 taken along line 11-11.
Figure 14:
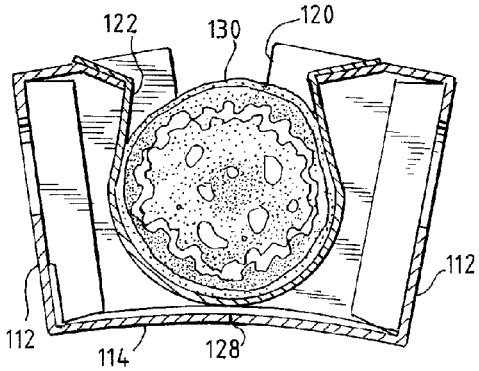
FIG. 14 is a cross-sectional elevation view of the tray of FIG. 10 taken along line 14-14.

The bottom wall 114 of the cooking apparatus 110 may contain a seam 128 or other line of weakness to allow the side walls 112 to pivot about the seam 128 and allow the cooking apparatus 110 to be opened to allow access to the food product 130, as illustrated in FIGS. 10 and 14. To further facilitate the opening of the cooking apparatus 110, each end wall 118 may have a perforated score line 120 generally aligned with the seam 128 of the bottom wall 114. As shown in FIG. 8, the end wall score line 120 comprises a portion above the center aperture 146 and below the center aperture 146. As illustrated in FIG. 10, the perforated score line 120 may be torn both above and below the aperture 146 to thereby separate the end wall 118 into two portions. Similar to the first embodiment, the torn score line 120 allows the end wall 118 to separate to thereby allow the side walls 112 to further pivot about the bottom wall seam 128. After cooling, the side walls 112 of the cooking apparatus 110 may then be pulled apart by pivoting along the seam 128 to open the cooking apparatus 100 and allow for access and removal of the food product 130 from the cooking apparatus 110.

Figure 15:
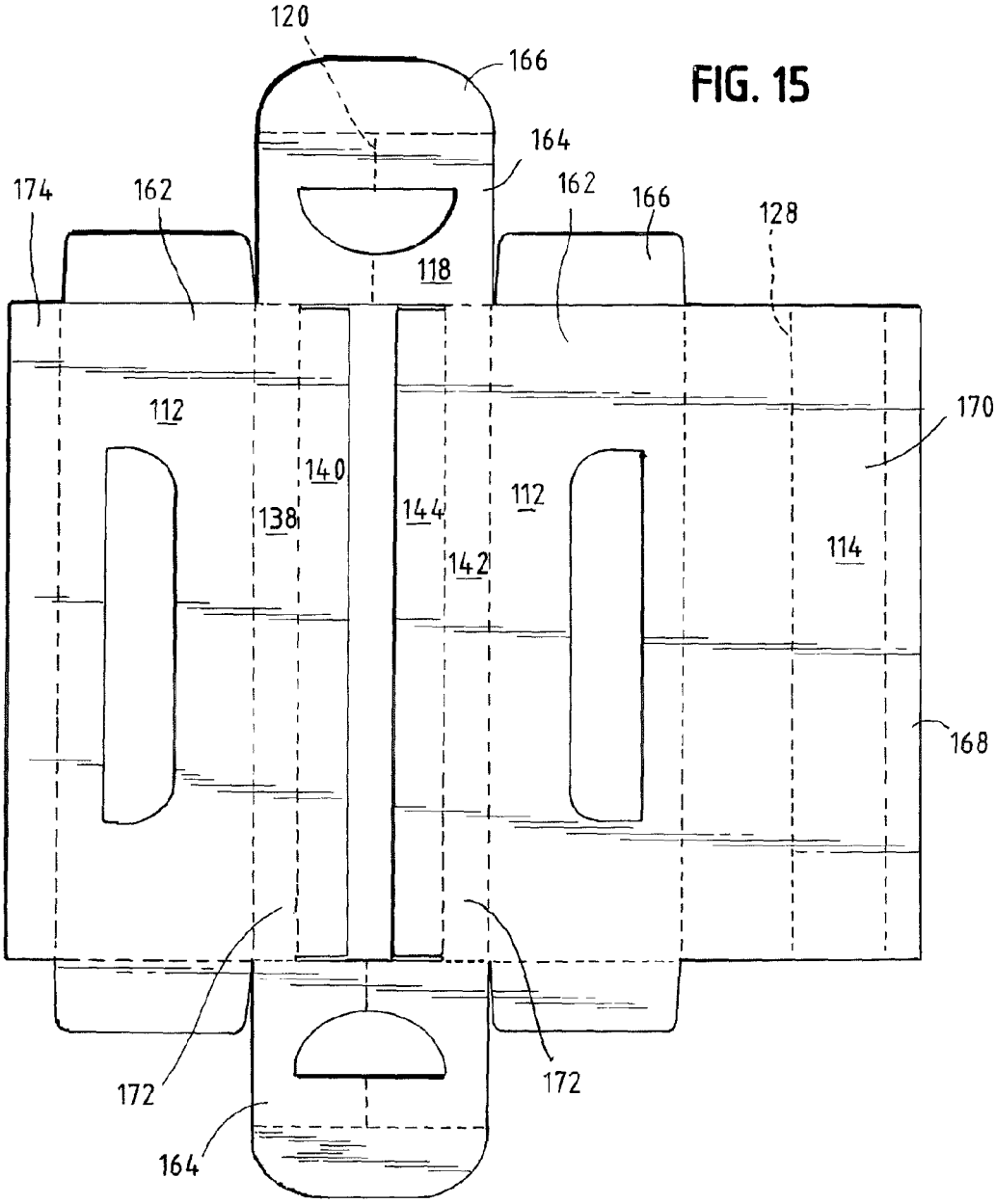
FIG. 15 is a plan view of a unitary blank for forming the tray of FIG. 8.
Figure 16:
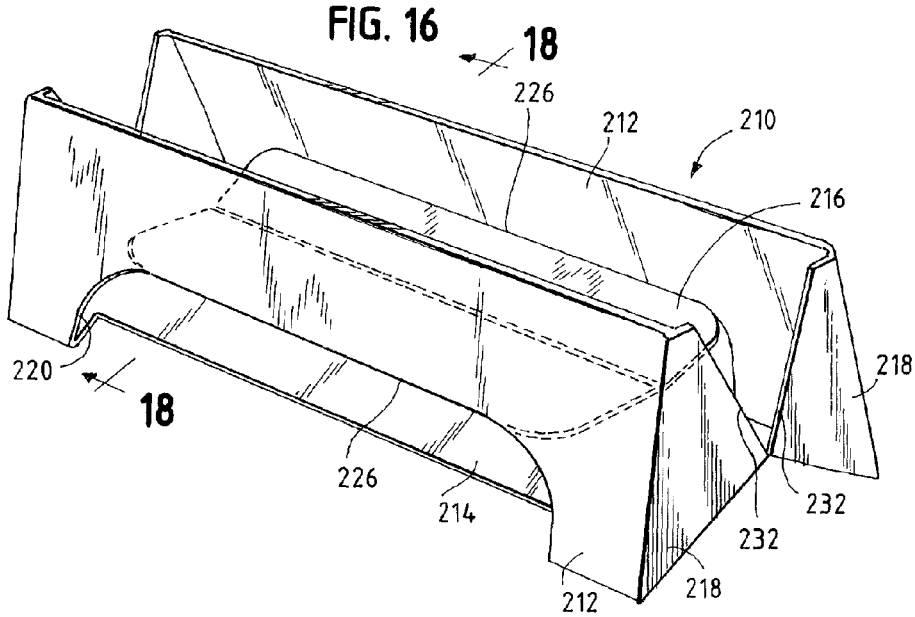
FIG. 16 is a perspective view of a third embodiment of a tray for microwave cooking of a food product.

Preferably, though not necessarily, the side walls 112, the bottom wall 114, and the end walls 118 of the cooking apparatus 110 are formed from a single unitary blank 150 of material, such as paperboard. Forming the cooking apparatus 110 from a single unitary blank 150 can eliminate the need for separately attaching any of the bottom wall, end walls, or side walls to each other. The unitary blank 150 includes multiple panels connected via fold lines, such as weakened or scored lines, as illustrated in FIG. 15, suitable for facilitating folding of the blank 150 into the cooking apparatus 110. The panels include a pair of side panels 162, a pair of end panels 164, and a bottom panel 170 connected to one of the side panels 162.

The pair of side panels 162 form the side walls 112 and the pair of end panels form the end walls 118. The extensions 126, 136 are formed by extension panels 172 that extend from each side panel 162 and between the two end panels 164, with a portion of each extension panel 172 being unattached to each end panel 162 to form the unattached portions 140, 144 of the extensions 126, 136. The bottom panel 170 extends from one of the side panels 162 and is folded under to form the bottom wall 114, with longitudinal tab 168 of the bottom panel 170 being attached to the longitudinal panel 174 of the other side panel 162 to form the cooking apparatus 110. The bottom panel 170 includes a score line or line of weakness 128 aligned with the perforated score line 120 to facilitate the pivoting of the side walls 112 and opening of the cooking apparatus 110. A plurality of tabs 166 are associated with each panel to assist in maintaining the blank 150 in a folded and assembled configuration. The susceptor 122 may be attached to the blank 150 upon completion of its folding or at intermediate steps thereof. The susceptor 122 may be attached to the blank 150 using, for example, an adhesive.

A third embodiment of a cooking apparatus 210 is illustrated in FIGS. 16-20. This cooking apparatus 210 includes a pair of side walls 212 and a base 214 extending between the pair of side walls 212. The base 214 includes a score line 228 or other line of weakness, such as, for example, a perforation, aperture, separation, or seam, or a combination thereof. The score line 228 allows the side walls 212 to pivot about the score line 228 to open and close the cooking apparatus for insertion and/or removal of a food product 230. A pair of inclined floor portions 216 are disposed in the cooking apparatus 210, with one edge 226 of each inclined floor portion 216 connected to one of the side walls 212 in an elevated position above the base 214. The opposite edge 224 of each inclined floor portion 216 is adjacent the base 214. Further the base-adjacent opposite edge 224 of one of the floor portions 216 is adjacent the base-adjacent opposite edge 224 of the other of the pair of floor portions 216. The elevated edge 226 is attached to the corresponding side wall 212 and the base-adjacent opposite edge 224 is unattached to the base, such that each inclined floor portion 216 is pivotable about the corresponding elevated edge 226. The elevated edge 226 may be continually attached along its length to the corresponding side wall 212 or may be partially attached to the side wall 212. The unattached base-adjacent edge 224 may also slide along the base 214 as the side walls 212 are moved and the inclined portions 216 are pivoted about the elevated edge 226.

The cooking apparatus 210 further includes a pair of upstanding end constraints 218 at each end of the base 214. Each end constraint 218 extends between the adjacent side wall 212, and a portion of the base 214 extending between the side wall 212 and the score line 228. Each end constraint 218 is illustrated as being generally triangular in shape, although other shapes may be contemplated. The side walls 212 and the end constraints 218 assist in controlling the product and restricting shifting or movement of the food product 230 prior to removal from the cooking apparatus 210, both before and after microwave cooking. In addition, the side walls 212 and end constraints 218 can contain portions of the food product 30 that may have escaped from the food product during cooking, thus providing spillage containment. The side walls 212 and the end constraints 218 can also be used to pick up or lift the cooking apparatus 210, to facilitate cool handling of the product 230 and apparatus 210. Each side wall 212 may have a vent aperture 220 formed therethrough to allow for the venting of steam during the cooking cycle. The vents 220 also facilitate cooling of the food product 230 and the cooking apparatus 210 after the cooking cycle. The vent aperture 220 may be formed from a cutout in the side wall 212 and base 214 that forms each inclined floor portion 216.

A susceptor surface 222 is disposed on at least the inner-facing portions of the side walls 212 and the inclined floor portions 216 of the cooking apparatus 210. A susceptor surface 222 may also be optionally disposed on the inner-facing portions of the end constraints 218 and the base 214. If desired, the susceptor surface 222 may cover the entire inner-facing portion of the cooking apparatus 210.

Figure 17:
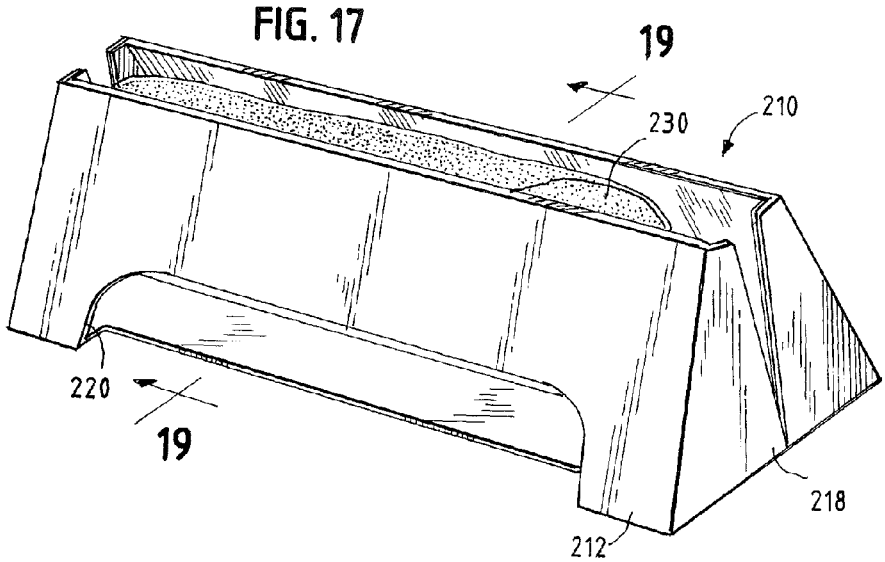
FIG. 17 is a perspective view of the tray of FIG. 16 shown in combination with a food product.
Figure 18:
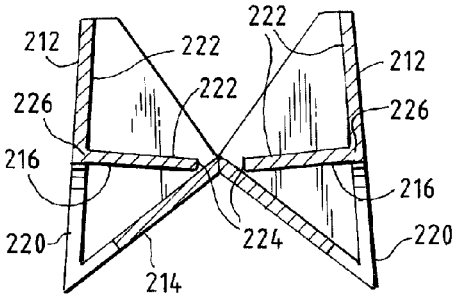
FIG. 18 is a cross-sectional elevation view of the tray of FIG. 16 taken along line 18-18.
Figure 19:
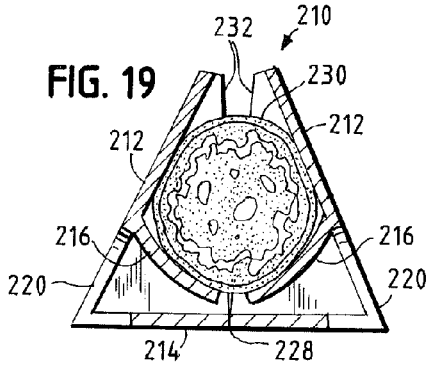
FIG. 19 is a cross-sectional elevation view of the tray of FIG. 17 taken along line 19-19.

When the cooking apparatus 210 does not contain a food product 230, the base 214 is generally divided into two angled portions having an apex at the score line 228, as shown in FIG. 18. In this empty position, a plurality of the cooking apparatus 210 may be nested together. When the food product 230 is inserted into the cooking apparatus 210, the weight of the food product 230 pushes down on the score line 228 to thereby substantially flatten the base 214. As the base 214 is substantially flattened by the weight of the food product 230, the side walls 212 pivot inward about the score line 228 to close around the food product, as shown in FIGS. 17 and 19, with opposing edges 232 of each end constraint 218 moving toward each other. By one approach, each of the end constraints 218 may be enlarged such that as the side walls 212 pivot inward about the score line 228 around the food product 230, the two end constraints 218 at each end will have overlapping portions to assist with food product and spillage containment. The inclined floor portions 216 may also bend due to the weight of the food product 230 and partially form to the generally circular cross-section of the food product 230. Thus, the susceptor surface 222 disposed on at least the inner side walls 212 and the inclined floor portions 216 will contact a plurality of locations around greater than 180 degrees of a circumference of the food product 230, as shown in FIG. 19. The cooking apparatus 210 is preferably used for food products having a generally circular cross-section, such as food products that are round, elliptical, curvilinear, polygonal, comprised of curved and straight edges, and so forth. The food product 230 in this embodiment is shown having a substantially circular cross-section, although other food product shapes may be contemplated. When it is desired to remove the food product 230 from the cooking apparatus 210, the side walls 212 may then be pivoted outwardly about the score line 228 to open the cooking apparatus 210 to allow access to the food product 230 therein.

Figure 20:
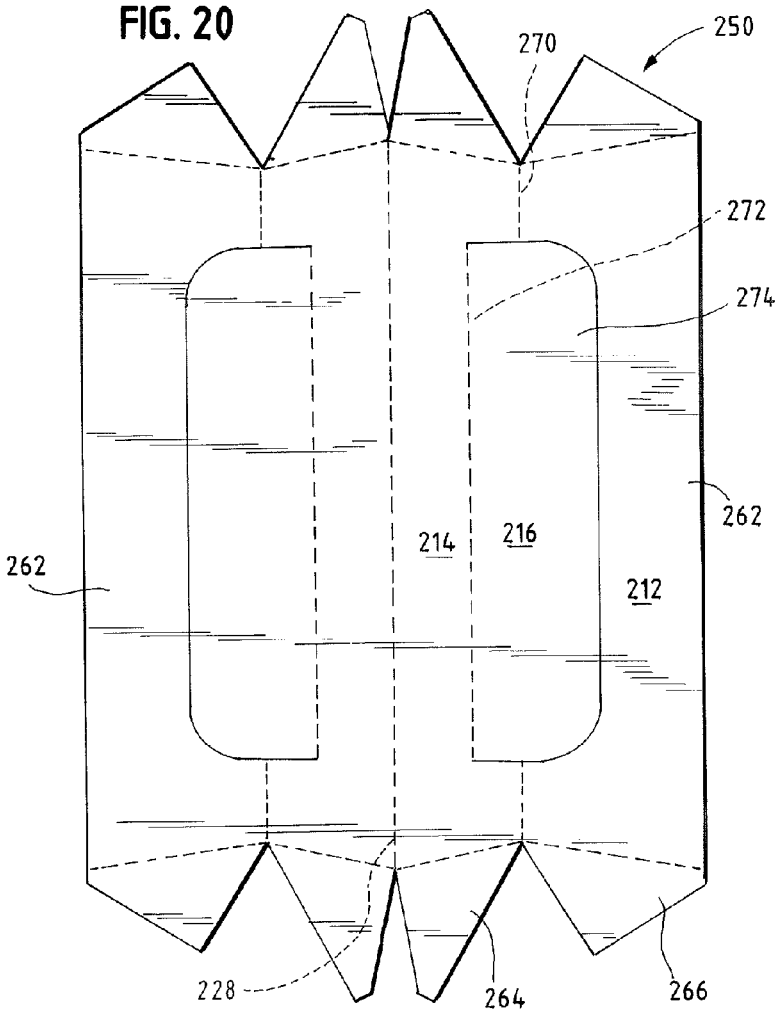
FIG. 20 is a plan view of a unitary blank for forming the tray of FIG. 16.
Figure 21:
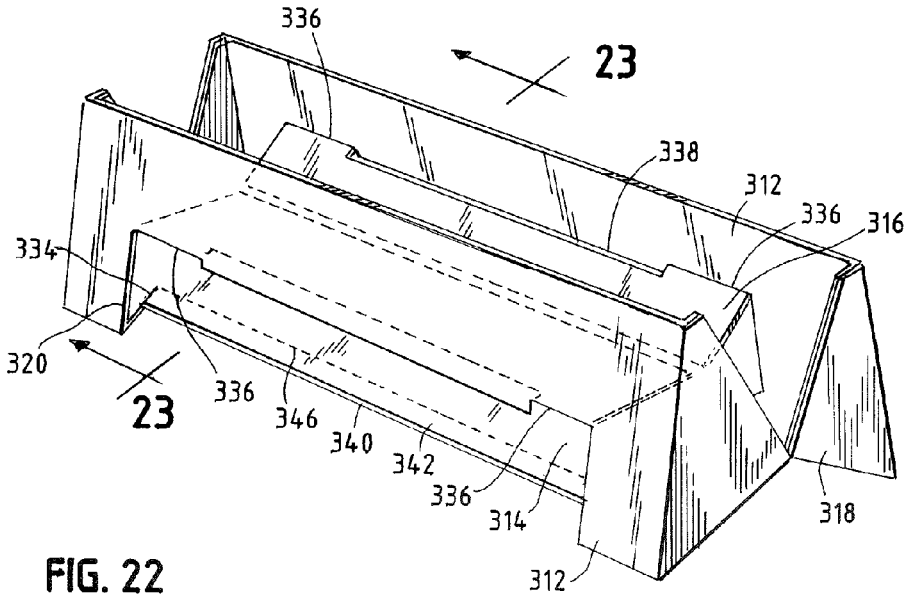
FIG. 21 is a perspective view of a fourth embodiment of a tray for microwave cooking of a food product.
Figure 22:
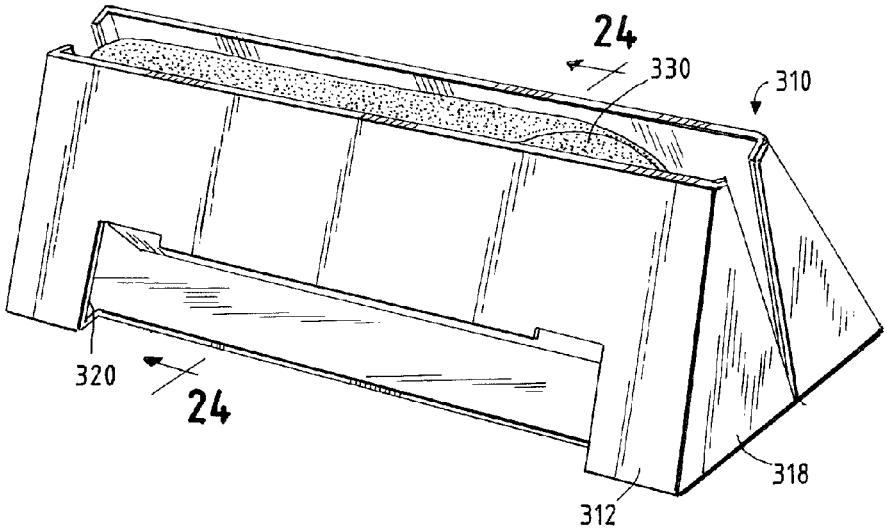
FIG. 22 is a perspective view of the tray of FIG. 21 shown in combination with a food product.
Figure 23:
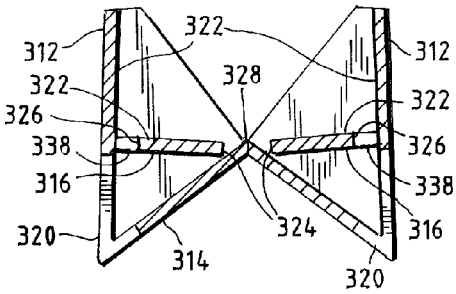
FIG. 23 is a cross-sectional elevation view of the tray of FIG. 21 taking along line 23-23.

Preferably, though not necessarily, the cooking apparatus 210 is formed from a single unitary blank 250 of material, such as paperboard. The unitary blank 250 includes multiple panels connected via fold lines, such as weakened or scored lines, as illustrated in FIG. 20, suitable for facilitating the folding of the blank 250 into the cooking apparatus 210. The panels include two panels 262 separated by the score line 228. Each panel 262 has a cutout 274 disposed therein to form the inclined floor portion 216. Each panel 262 is folded up along fold line 270 to form the base portion 214 with the score line 228 disposed therein. The folded up portions of each panel 262 form the side walls 212. The cutout 274 is attached along fold line 272 and detached along all other sides and folds in to form the inclined floor portion 216. The triangle portion 264 extending from the base floor 214 and the triangle portion 266 extending from the side wall 212 are then folded and overlapped to form the end constraint 218. The susceptor surface 222 can be disposed on the cooking apparatus 210 after the cooking apparatus 210 has been formed or may be preferably disposed on the unitary blank 250 prior to its folding into the cooking apparatus 210, or at intermediate steps thereof.

A fourth embodiment of a cooking apparatus 310 is illustrated in FIGS. 21-25. The apparatus 310 is similar in construction to the third embodiment illustrated in FIGS. 16-20, but with some modifications and additional features. Similar to the third embodiment, this cooking apparatus 310 includes a pair of side walls 312 and a base 314 extending between the pair of side walls 312. The base 314 includes a score line 328 or other line of weakness, which allows the side walls 312 to pivot about the score line 328 to open and close the cooking apparatus 310 for insertion and/or removal of a food product 330. A pair of inclined floor portions 316 are disposed in the cooking apparatus 310, with one edge 326 of each inclined floor portion 316 connected to one of the side walls 312 in an elevated position above the base 314. The opposite edge 324 of each inclined floor portion 316 is adjacent the base 314. The elevated edge 326 is attached to the corresponding side wall 212 and the base-adjacent opposite edge 324 is unattached to the base, such that each inclined floor portion 316 is pivotable about the corresponding elevated edge 226. In this embodiment, the elevated edge 326 is attached at each end 336 to the corresponding side wall 312, such that a center portion of the elevated 326 is spaced by a gap 338 from the side wall 312. This gap facilitates faster heat dissipation and venting of steam as the food product 330 is cooked and cooled.

Like the third embodiment, the cooking apparatus 310 includes a pair of upstanding end constraints 318 at each end of the base 314, with each end constraint 318 extending between the adjacent side wall 312 and a portion of the base 314 between the side wall 312 and the score line 328. The side walls 312, base 314, and the end constraints 318 assist in controlling the product and restricting shifting or movement of the food product 330 while the food product 330 is in the cooking apparatus 310, and also facilitate cool handling of the cooking apparatus 310. Each side wall 312 may have a vent aperture 320 formed therethrough to allow for the venting of steam during the cooking cycle. The vents 320 also facilitate cooling of the food product 330 and the cooking apparatus 310 after the cooking cycle. The vent aperture 320 may be formed from a cutout in the side wall 312 and base 314 that also forms each inclined floor portion 316. In this embodiment, the base edge 340 of the vent aperture 320 includes a flap portion 342 that is unattached to the base at its edges 344 so that it may fold or pivot about a perforated score line 346. This flap portion 342 facilitates the nesting and stacking of a plurality of empty cooking apparatus 310 units by pivoting about the score line to accommodate the structure of an adjacent nested cooking apparatus 310.

Figure 24:
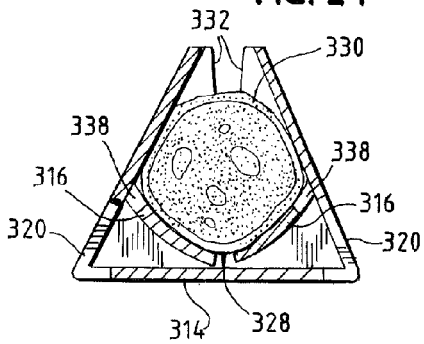
FIG. 24 is a cross-sectional elevation view of the tray of FIG. 22 taken along line 24-24.

As with the third embodiment, the weight of the food product 330 pushes down on the score line 328 to thereby substantially flatten the base 314 when a food product 330 is inserted into the cooking apparatus 310. The weight of the food product 330 also causes the side walls 312 to pivot inwardly about the score line 328 and close around the food product 330, as shown in FIG. 24, with opposing edges 332 of each end constraint 318 moving toward each other. By one approach, each of the end constraints 318 may be enlarged such that as the side walls 312 pivot inward about the score line 328 around the food product 330, the two end constraints 318 at each end will have overlapping portions to assist with food product and spillage containment. The inclined floor portions 316 may also bend due to the weight of the food product 330 and partially form to the generally circular cross-section of the food product 330. Each inclined floor portion 316 is positioned at approximately a 45 degree angle from the base 314 when the food product is placed in the cooking apparatus 310. As a result, the susceptor surface 322 disposed on at least the inner side walls 312 and the inclined floor portions 316 will contact a plurality of locations around greater than 180 degrees of a circumference of the food product 330, as shown in FIG. 24. To open the cooking apparatus 310 to access the food product 330, the side walls 312 may then be pivoted outwardly about the score line 328 to open the cooking apparatus 310. The cooking apparatus 310 is preferably used for food products having a generally circular cross-section, such as food products that are round, elliptical, curvilinear, polygonal, comprised of curved and straight edges, and so forth.

Figure 25:
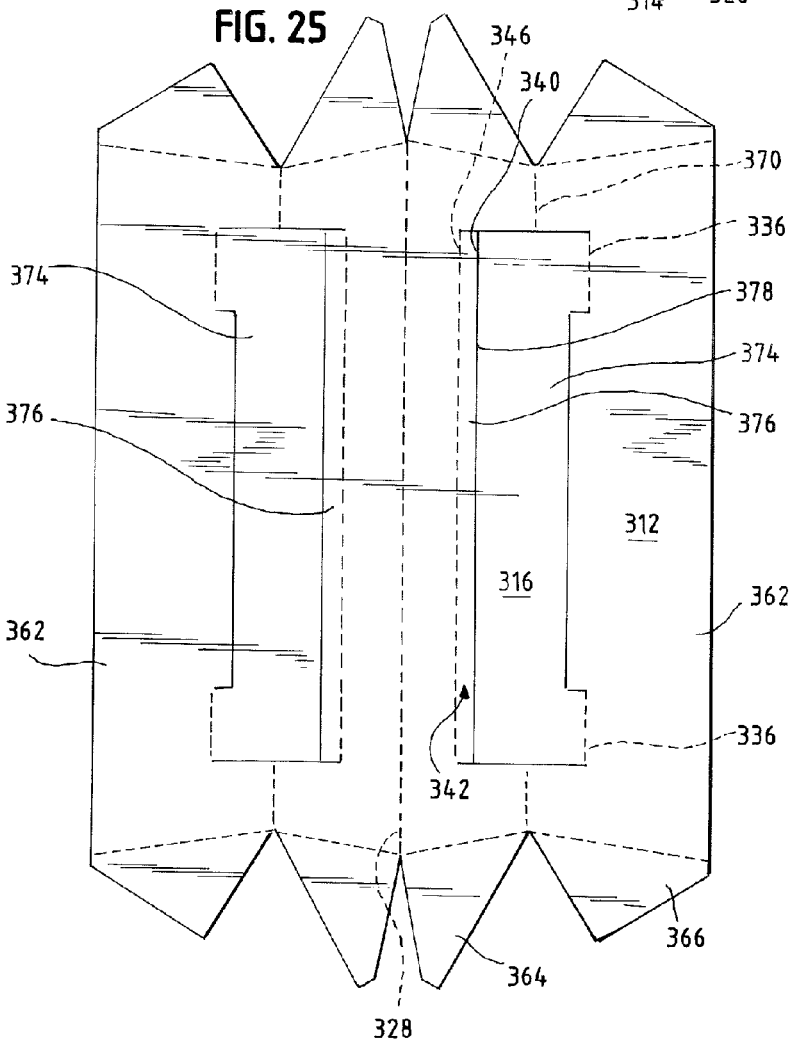
FIG. 25 is a plan view of a unitary blank for forming the tray of FIG. 21.

Preferably, though not necessarily, the cooking apparatus 310 is formed from a single unitary blank 350 of material, such as paperboard. The unitary blank 350 includes multiple panels connected via fold lines, such as weakened or scored lines, as illustrated in FIG. 25, suitable for facilitating folding of the blank 350 into the cooking apparatus 310. The panels include two panels 362 separated by the score line 328. Each panel 362 has a cutout 374 disposed therein to form the inclined floor portion 316. Each panel 362 is folded up along fold line 370 to form the base portion 314 with the score line 328 disposed therein. The folded up portions of each panel 362 form the side walls 312. The cutout 374 is attached to the side wall portion 312 of the panel 362 at fold line 336, and detached from the panel 362 on all other sides, with the cutout being folded in along fold lines 336 to form the inclined floor portion 316. A second cutout 376 is disposed adjacent the first cutout 374. The second cutout 376 is attached to the base portion 314 of the panel 362 along fold line 346 and detached from the panel 362 on all other sides. The first cutout 374 and the second cutout 376 have adjacent detached edges 378, 340 respectively. A triangle panel 364 extending from the base floor 314 and a triangle panel 366 extending from the side wall 312 are then folded and overlapped to form the end constraint 318. The susceptor surface 322 can be disposed on the cooking apparatus 310 after the cooking apparatus 310 has been formed or may be preferably disposed on the unitary blank 350 prior to its folding into the cooking apparatus 310, or at intermediate steps thereof.

The drawings and the foregoing descriptions are not intended to represent the only forms of the cooking apparatus in regard to the details of construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation. In addition, various features from any of the different embodiments specifically discussed herein can be combined with others of the different embodiments.

I claim:

1. A cooking apparatus for use in microwave cooking of a food product, the cooking apparatus comprising:

a pair of side walls;

a bottom wall extending between the pair of side walls; and at least one susceptor surface suspended and hanging between the pair of side walls and configured to contact a plurality of locations around greater than 180 degrees of a circumference of the food product, wherein the susceptor surface is flexible to permit the susceptor surface to generally conform to at least a portion of the circumference of the food product.

2. A cooking apparatus in accordance with claim 1 including a line of weakness on the bottom wall about which the side walls are pivotable.

3. A cooking apparatus in accordance with claim 1 wherein the pair of side walls are spaced a predetermined distance apart by the bottom wall and a pair of opposed end walls.

4. A cooking apparatus in accordance with claim 1 including a pair of inclined floor portions each having one edge elevated above the bottom wall.

5. A cooking apparatus in accordance with claim 4 wherein the susceptor surface is disposed on at least the side walls and the inclined floor portions.

6. A cooking apparatus in accordance with claim 1 comprising:

means for providing cool handling of the cooking container following microwave heating.

7. A cooking apparatus in accordance with claim 1, wherein the food product has a generally circular cross-section.

8. A cooking apparatus for use in microwave cooking of a food product, the cooking apparatus comprising:

a pair of side walls;

a bottom wall extending between the pair of side walls; and at least one susceptor surface suspended between the pair of side walls and configured to contact a plurality of locations around greater than 180 degrees of a circumference of the food product, wherein the susceptor surface is flexible to permit the susceptor surface to generally conform to at least a portion of the circumference of the food product, and wherein the susceptor surface comprises a suspended susceptor having one side being attached to one of the pair of side walls, an opposing side being attached to the other of the pair of side walls, and a portion of the susceptor positioned between the one side and the opposing side hanging into a space between the pair of side walls.

9. A cooking apparatus in accordance with claim 8, wherein the food product has a generally circular cross-section.

10. A method of microwave cooking a food product, the method comprising:

providing a food product container comprising a pair of opposed upstanding side walls having one or more susceptor surfaces suspended therebetween and a bottom wall extending between the pair of side walls; and inserting a generally circular food product having a longitudinal axis extending through the center of the circular aspect of the food product into the food product container such that the longitudinal axis is generally parallel with the bottom wall and the susceptor surface contacts a plurality of locations around greater than 180 degrees of a circumference of the food product.

11. A method in accordance with claim 10 further comprising opening the food product container after cooling along a line of weakness in the food product container to provide access to the food product for removal of the food product.

12. A method in accordance with claim 11 wherein the food product container comprises the pair of opposed upstanding side walls spaced a predetermined distance apart by the bottom wall and a pair of end walls and the suspended susceptor having one side being attached to one of the pair of side walls and an opposing side being attached to the other of the pair of side walls.

13. A method in accordance with claim 12 wherein inserting the food product into the food product container further comprises rotating top portions of the side walls inwardly upon insertion of the food product.

14. A method in accordance with claim 12 wherein each end wall includes a perforated score line aligned with the line of weakness, and opening the food product container further comprises separating the end walls along the score lines.

15. A method of microwave cooking a food product, the method comprising:

providing a food product container having one or more susceptor surfaces;

inserting a generally circular food product into the food product container such that the susceptor surface contacts a plurality of locations around greater than 180 degrees of a circumference of the food product;

opening the food product container after cooling along a line of weakness in the food product container to provide access to the food product for removal of the food product;

wherein the food product container comprises a pair of opposed upstanding side walls spaced a predetermined distance apart by a bottom wall and a pair of end walls and a suspended susceptor having one side being attached to one of the pair of side walls and an opposing side being attached to the other of the pair of side walls; and wherein the food product container includes a pair of inwardly directed extensions that are each partially attached at each end to a corresponding one of the end walls, wherein each extension includes a fold line between an attached portion of the extension and an unattached portion of the extension, and wherein inserting the food product into the food product container comprises pushing the food product against the extensions such that each extension folds along the fold line to accommodate the food product.

16. A combination of a cooking apparatus and a food product, the cooking apparatus for use in microwave cooking of the food product, the combination comprising:

a generally circular food product; and a cooking apparatus having a pair of opposed upstanding side walls spaced apart a predetermined first distance by a bottom wall, the bottom wall located between a bottom edge of each side wall, an inwardly directed extension extending from each side wall at a location above the bottom wall and supporting a susceptor therebetween, with an end portion of one extension being spaced by a predetermined second distance from an end portion of the other extension and the extensions are foldable to permit the food product to be inserted therebetween, wherein the second distance between the ends of the extensions is less than a diameter of the food product and the first distance is greater than the diameter of the food product.

17. The combination in accordance with claim 16 wherein the susceptor is flexible to permit the susceptor to generally conform to at least a portion of a circumference of the food product.

18. A cooking apparatus for use in microwave cooking of a food product, the cooking apparatus comprising:

a pair of side walls;

a bottom wall extending between the pair of side walls; and at least one susceptor surface suspended between the pair of side walls and configured to contact a plurality of locations around greater than 180 degrees of a circumference of the food product, the cooking apparatus further comprising a pair of inwardly directed extensions that are each attached to a corresponding one of the side walls, and wherein the susceptor is attached to each of the extensions.

19. A cooking apparatus in accordance with claim 18 including a line of weakness on the bottom wall about which the side walls are pivotable.

20. A cooking apparatus in accordance with claim 18 wherein the pair of side walls are spaced a predetermined distance apart by the bottom wall and a pair of opposed end walls.

21. A cooking apparatus in accordance with claim 18 including a pair of inclined floor portions each having one edge elevated above the bottom wall.

22. A cooking apparatus in accordance with claim 21 wherein the susceptor surface is disposed on at least the side walls and the inclined floor portions.

* * * * *